US005157946A

United States Patent [19]

Egea et al.

[11] Patent Number: 5,157,946

[45] Date of Patent: Oct. 27, 1992

[54] APPARATUS FOR TRANSFERRING KNITTED FABRIC FROM CIRCULAR KNITTING MACHINE

[75] Inventors: Noel Egea, Sumene, France; Hidemasa Sakamoto, Bunsui; Keizi Shimizu, Tokyo, both of Japan

[73] Assignee: Nagata Seki Kabushiki Kaisha, Tokyo, Japan

[21] Appl. No.: 781,744

[22] Filed: Oct. 23, 1991

[30] Foreign Application Priority Data

Oct. 24, 1990 [JP] Japan ..... 2-286331
Oct. 24, 1990 [JP] Japan ..... 2-286332
Nov. 9, 1990 [JP] Japan ..... 2-304451

[51] Int. Cl.[5] ..... D04B 15/92
[52] U.S. Cl. ..... 66/149 S; 66/147
[58] Field of Search ..... 66/147, 148, 149 R, 66/149 S

[56] References Cited

U.S. PATENT DOCUMENTS 2,844,952 7/1958 Wawzonek ..... 66/149 S
3,473,350 10/1969 Scheel ..... 66/149 S
4,287,729 9/1981 Mamimi ..... 66/149 S
4,339,932 7/1982 Lomati ..... 66/149 S X
4,454,729 6/1984 Lomati ..... 66/149 S X
5,052,196 10/1991 Turimi ..... 66/149 S

FOREIGN PATENT DOCUMENTS 1222893 6/1960 France ..... 66/149 S
4720587 7/1969 Japan .

*Primary Examiner*—Werner H. Schroeder
*Assistant Examiner*—John J. Calvert
*Attorney, Agent, or Firm*—Ladas & Parry

[57] ABSTRACT

A cylindrically knitted fabric is produced in a knitting region adjacent to the top of a needle cylinder of a knitting machine. The knitted fabric is guided downward around a conical nozzle and fed downward in a twisting-preventive guide cylinder rotating in synchronism with the needle cylinder. Air is ejected downward from air openings around the conical nozzle so that the knitted fabric is moved downward. Air is ejected downward from the nozzle into the cylindrical knitted fabric, which is thereby pressed against the inner surface of the guide cylinder. Upon being thus delivered from the bottom of the guide cylinder without contamination and twist, the knitted fabric is received on a conical gripper and is then conveyed by a pickup mechanism to a next processing step for producing socks, panty hose or tights.

13 Claims, 11 Drawing Sheets

APPARATUS FOR TRANSFERRING KNITTED FABRIC FROM CIRCULAR KNITTING MACHINE

BACKGROUND OF THE INVENTION

The present invention relates to an apparatus for transferring a knitted fabric from a circular knitting machine while preventing twisting of the knitted fabric which is a cylindrical fabric used to produce socks, panty hose, tights or the like.

Japanese Patent Publication No. 47-20587 published Jun. 10, 1972 discloses an apparatus for taking out a cylindrically knitted fabric knitted by a circular knitting machine. The apparatus comprises an upright hollow guide cylinder disposed concentrically within the needle cylinder so as to rotate in synchronism with the needle cylinder. The guide cylinder is perforated, and a cylindrically knitted fabric produced in the knitting region adjacent to the top portion of the needle cylinder is fed downward within the guide cylinder to be delivered through a bottom opening of the guide cylinder. There is provided a suction device that evacuates air around the perforated guide cylinder to cause the cylindrically knitted fabric to be pressed against the inner surface of the guide cylinder. The suction is exerted from a lateral side of the guide cylinder, as will be described in detail hereinafter.

In the known apparatus described above, the knitted fabric being fed downward under suction tends to be biased and sucked against only a lateral portion of the inner wall of the perforated guide cylinder because of the exertion of the suction from only a lateral side. As a result, the knitted fabric within the guide cylinder is urged only partially onto the inner wall of the guide cylinder while being fed downward due to the weight of the succeeding part of the fabric. This often causes rubbing of the fabric on the guide cylinder and on a gear box in the vicinity of the lower portion of the guide cylinder. As a result of this, the knitted fabric is contaminated and damaged with consequent twisting and degradation thereof.

Furthermore, in the known apparatus described above, the knitted fabrics fed downward through the guide cylinder are dropped through the bottom opening of the guide cylinder and are then stored in a storage box provided below the bottom opening. The fabrics stored in the storage box must be manually picked up to convey them to a next processing step for producing socks, panty hose or tights.

SUMMARY OF THE INVENTION

It is therefore an object of the present invention to eliminate the above stated problems and to provide an apparatus for reliably transferring a knitted fabric from a circular knitting machine without contamination, damage, twisting and degradation of the fabric.

The present invention also aims at providing an apparatus of the above kind wherein the knitted fabrics can be reliably transferred to a next processing step without manual labor.

According to the present invention, there is provided an apparatus for transferring a knitted fabric from a circular knitting machine having a rotating upright needle cylinder carrying knitting needles, and a dial mechanism provided above the top of the needle cylinder, said needle cylinder having therein an upright hollow guide cylinder which rotates in synchronism with the needle cylinder and through which a cylindrical fabric knitted in a knitting region adjacent to the top of the needle cylinder is fed downward, and means for pneumatically drawing the knitted fabric against the inner surface of the cylindrical guide, said apparatus comprising a conical air nozzle provided in the top of the needle cylinder concentrically therewith and having a downwardly converging frustoconical outer surface, said nozzle being so disposed directly below said knitting region as to guide the cylindrically knitted fabric downward along and around said frustoconical outer surface and as to eject air downward into the cylindrically knitted fabric to pneumatically urge the fabric against the inner surface of the guide cylinder; opening means provided around said air nozzle for blowing air downwardly to cause the cylindrically knitted fabric around the air nozzle to be pneumatically moved downward; and knitted fabric pickup means provided below the needle cylinder for picking up the knitted fabric deposited below said guide cylinder and for transferring the fabric away from the knitting machine.

The present invention will be described in detail hereinbelow with reference to the accompanying drawings.

DESCRIPTION OF THE PREFERRED EMBODIMENTS

Prior to the description of the preferred embodiments of the present invention, the above described apparatus for transferring knitted fabrics from a knitting machine will be briefly described.

Figure 18:
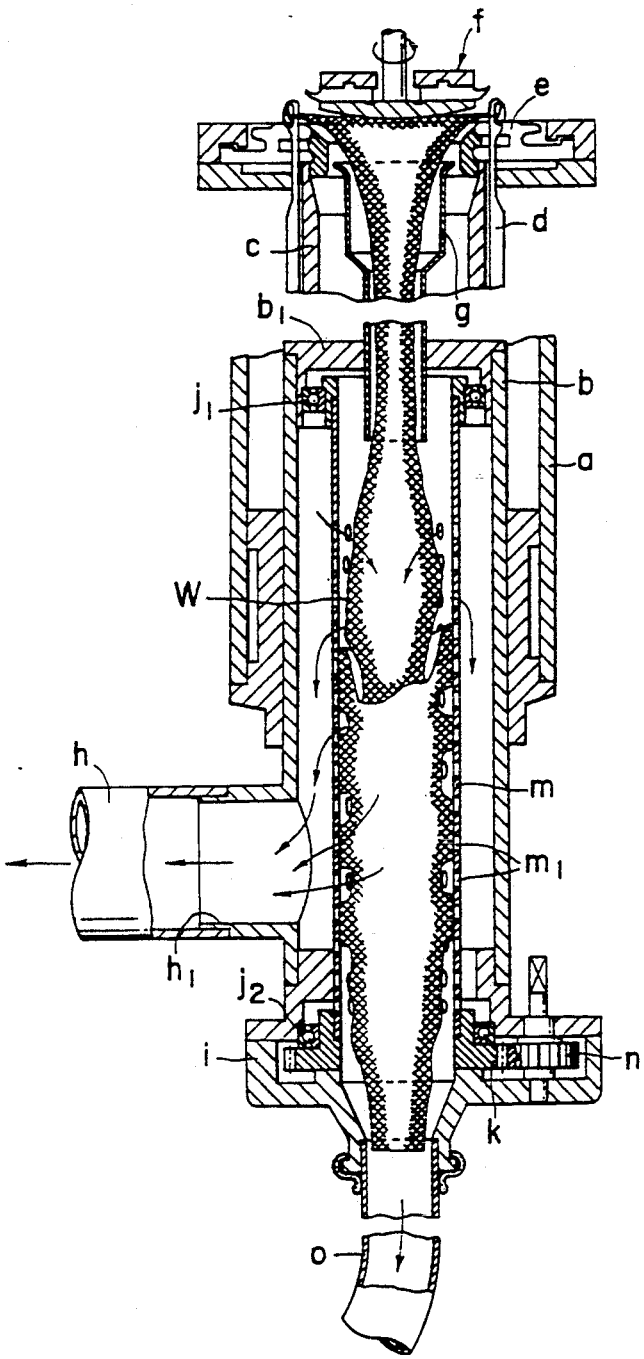
FIG. 18 PRIOR ART
FIG. 18 is a vertical section showing an essential part of a known apparatus for transferring a knitted fabric.

Referring to FIG. 18, an outer body b in the form of a cylinder is disposed upright at a base portion of a supporting frame a of a circular knitting machine, and a conventional needle cylinder c is rotatably fitted in the upper end portion of the outer body b. The needle cylinder has a plurality of longitudinally extended grooves and knitting needles d are fitted into the respective grooves in such a way that the needles d can vertically slide by a cam mechanism (not shown). Disposed at the upper stroke end of the needles d are conventional sinkers e in such a way that they are caused to slide in radial directions by sinker cams in union with the vertical movement of the needles d. Furthermore, a conventional dial mechanism f is mounted on a machine frame (not shown) immediately above the cylinder c in such a way that it can rotate in synchronism with the needle cylinder c.

A frusto-conical guide cylinder g is mounted on a cover b1 of the outer body b in such a way that the knitted fabric knitted by the co-action of the knitting needles d and the sinker e is guided. Connected to a portion of the outer body b located below the guide cylinder g is a horizontally extended suction pipe h with a suction port h1 so that air is drawn outwardly. A gear box i is mounted at the lower end of the outer body b and bearings j1 and j2 are mounted on upper portions of the gear box i and the outer body b. A perforated guide cylinder m integral with a gear k is rotatably supported by the bearings j1 and j2, and a large number of air holes m1 formed through the cylindrical wall of the perforated guide cylinder are communicated with the suction port h1 so that air is sucked and discharged to the exterior. A pinion is in mesh with the gear k which rotates the perforated guide cylinder m in synchronism with the rotation of the cylinder c. The lower end portion of the gear box i is connected to a discharge pipe o through which the knitted fabric W is guided toward a storage box (not shown).

In the knitting operation, the above-described apparatus, knitted fabrics such as socks, panty hose, tights or the like are guided downwardly through the guide cylinder g, and the gear k is rotated through the pinion in the gear box i in synchronism with the rotation of the needle cylinder c, while air is evacuated through the air port h1 of the suction pipe h. Consequently, each knitted fabric is withdrawn into the lower discharge pipe o while the knitted fabric is being sucked against the inner cylindrical wall surface of the perforated guide cylinder m.

In the apparatus for transferring knitted fabrics of the type described above, the air holes m1 formed through the perforated guide cylinder m are communicated with the suction port h1 so that when the knitted fabric W approaches the inner wall surface of the guide cylinder m, it is biased and sucked on a lateral portion of the wall surface of the guide cylinder m so that part of the knitted fabric W is sucked laterally outwardly through the air holes m1 and then is fed downward due to the weight of the succeeding part of the knitted fabric. As a result, the knitted fabric is rubbed within the gear box i in the vicinity of the lower end portion of the perforated guide cylinder m so that part of the knitted fabric is contaminated and damaged and consequently the knitted fabric is twisted and degraded in quality.

The present invention has been made to overcome the above and other problems encountered in the conventional apparatus and will become apparent from a description of preferred embodiments below.

Figure 1:
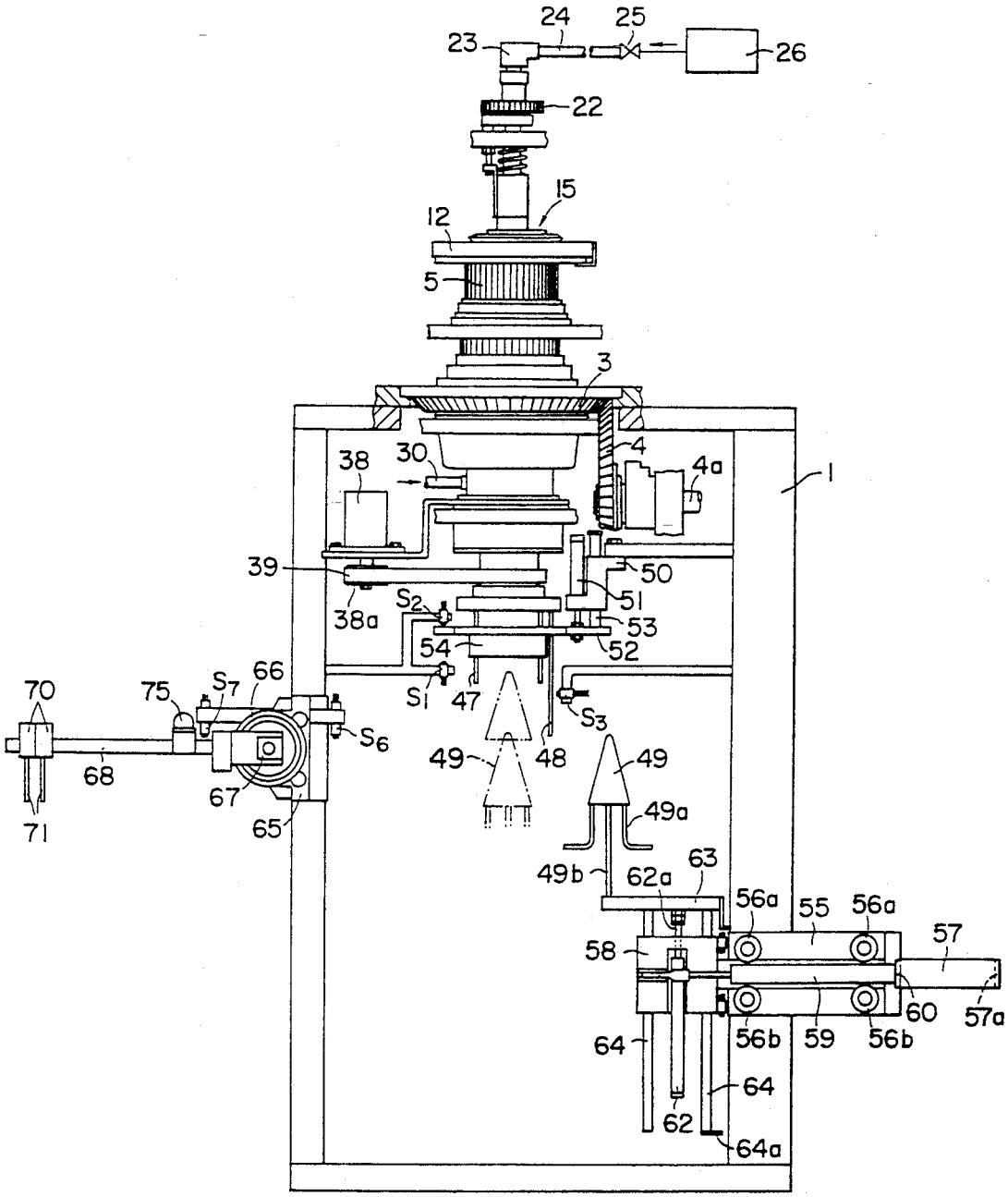
FIG. 1 is a front elevation of a circular knitting machine installed with an apparatus for transferring a knitted fabric from the knitting machine, according to the present invention.
Figure 2:
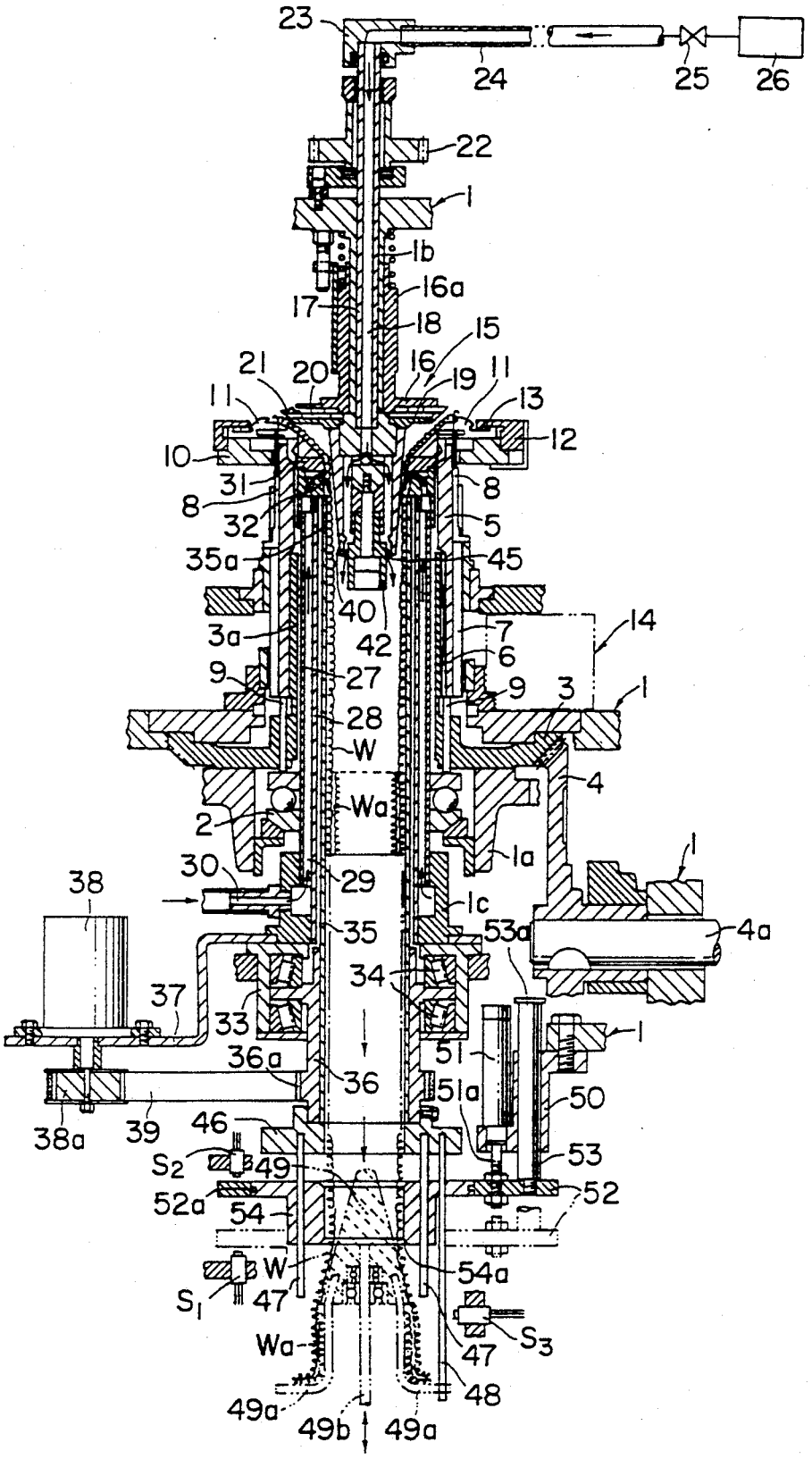
FIG. 2 is a vertical section, on an enlarged scale, of an essential part of the apparatus shown in FIG. 1.

Referring first to FIG. 1, the knitting machine shown has a machine frame 1. As shown in FIG. 2, a bearing 2 is disposed at the center portion 1*a* of the machine frame 1 in such a way that the bearing 2 can be vertically moved by a cam mechanism (not shown). A bevel gear 3 is rotatably supported by the bearing 2, and a driving gear 4 in mesh with the bevel gear 3 is securely carried by a drive shaft 4*a* which in turn is rotatably supported by the machine frame 1, whereby the driving gear 4 in mesh with the bevel gear 3 rotates the gear 3. The bevel gear 3 has a hollow cylindrical portion 3*a* integral and coaxial therewith. A conventional needle cylinder 5 is rotatably fitted through a sliding key 6 over the cylindrical portion 3*a* so as to be slidable in the axial direction (that is, in the vertical direction). A large number of needle grooves 7 are formed on the outer cylindrical surface of the needle cylinder 5 so as to extend in the lengthwise direction of the cylinder. Conventional jacks (not shown) and knitting needles 8 are vertically slidably fitted in the respective needle grooves 7. The needle cylinder 5 is fitted in such a way that it can be rotated and can be vertically moved by means of the bearing 2 which can be vertically moved by the cam mechanism and through a plurality of raising rods 9. A known raising cam (not shown) is mounted on the machine frame at a position below the path of rotation of the lower ends of the jacks in such a way that the jacks and the knitting needles 8 will be vertically moved together. A conventional sinker bed 10 is mounted on the upper end of the needle cylinder 5 and a number of sinker grooves are formed on the surface of the sinker bed 10 so as to extend in radial directions with respect to the axis of the needle cylinder 5. Each sinker 11 for knitting the stitches is loosely fitted in each sinker groove and is slidably moved toward and away from the axis of the needle cylinder 5 by a sinker cam 13 of a sinker cap 12 disposed on an upper table fixed to the machine frame 1.

A patterning device (needle selecting device) 14 is disposed at the outer portion of the machine frame 1 in opposing relationship with the jacks.

A dial cap 16 of a conventional dial mechanism 15 is coaxially fitted over a hollow shaft 1*b* of the machine frame 1, extending upwardly beyond the needle cylinder 5. A rotary hollow shaft 17 is fitted in a hollow shaft 1*b* inside a hollow shaft 16*a* of the dial cap 16 in such a way that the shaft 17 can be rotated in synchronism with the needle cylinder 5. An air supply passage 18 is defined within the shaft 17. A dial 19 is extended horizontally from the rotary hollow shaft 17 to an extent above the outer periphery of the needle cylinder 5. A conventional transfer jack 20 is attached to an outer end portion of the dial 19. The dial cap 16 and the dial 19 immediately above the transfer jack 20 are equipped with a yarn cutter 21 consisting of a stationary cutter and a movable circular cutter so as to cut the trailing end of the yarn.

A transmission gear 22 is securely carried by the upper portion of the rotary hollow shaft 17 to rotate the same in synchronism with the needle cylinder 5. A pipe joint 23 is loosely fitted through a sealing member at the upper end of the rotary hollow shaft 17, and a supply pipe 24 of the pipe joint 23 is communicated through a solenoid control valve 25 with a compressed air source 26.

An outer cylinder 27 and an inner cylinder 28, which are extended coaxially and define an air passage 29 therebetween, are mounted on a holder 1*c* fixed to an inner lower end of the machine frame 1. A portion of the holder 1*c* located below the lower ends of the outer and inner cylinders 27 and 28 has connected thereto an air supply conduit 30 for supplying compressed air. Formed through an upper connecting member 31 between the outer and inner cylinders 27 and 28 are openings 32 for blowing air downwardly so as to move the cylindrically knitted fabric W downward. A bearing case 33 is fixed to the lower portion of the holder 1*c* for housing bearings 34. A short hollow shaft 36 integral with a twisting-preventive guide cylinder 35 is supported by the bearings 34 in such a way that the short hollow shaft 36 will be rotatable in unison with the needle cylinder 5. The upper portion 35*a* of the twisting-preventive guide cylinder 35 is extended upwardly as high as the upper portion of the inner cylinder 28 and is fixed thereat. A pulley 36*a* is fixedly mounted to the short hollow shaft 36 and is coupled through a timing belt 39 to the output shaft 38*a* of a stepper motor 38 mounted on a supporting stand 37 extending from the holder 1*c*.

Figure 3:
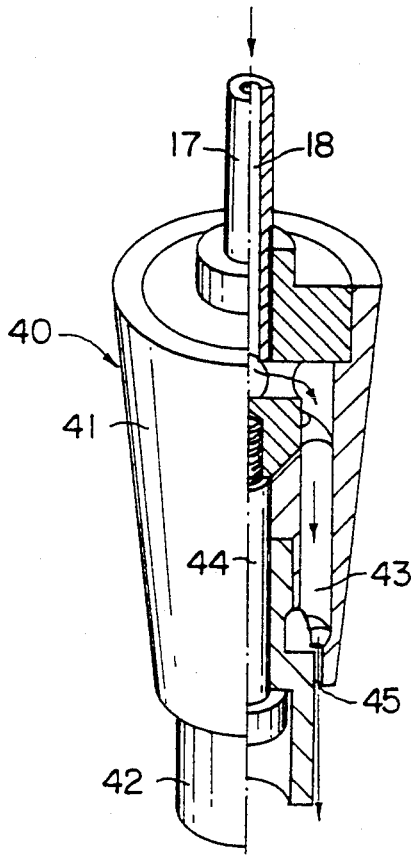
FIG. 3 is a perspective view, on a more enlarged scale, of a conical nozzle shown in FIG. 2.
Figure 4:
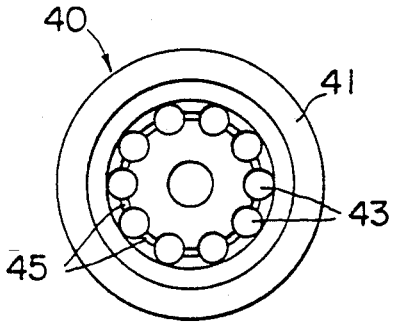
FIG. 4 is a plan view of the conical nozzle with some members thereof removed.

The dial 19 of the dial cap 16 is connected to a conical nozzle 40 best shown in FIGS. 3 and 4. The nozzle 40 communicates with the air supply passage 18 so that the air can be ejected downwardly. More specifically, the conical nozzle 40 consists of a frustoconical body 41 and a nozzle body 42 with a plurality of air ejection passages 43. The nozzle body is joined to the frustoconical body 42 by bolt 44. At the lower portion of the nozzle body 42, injection openings 45 are provided which are directed downwardly and communicated with the injection passages 43.

Referring back to FIG. 2, the lower ends of the twisting-preventive guide cylinder 35 and the short hollow shaft 36 are joined to a disk-shaped rotating ring 46, and a plurality (four in FIG. 2) of guide rods 47 depend from the lower surface of the rotating ring 46. Also an actuating rod 48 is extended downwardly beyond the lower ends of the guide rods 47 and radially outwardly thereof to engage a L-shaped rod 49*a* of a vertically movable conical holder 49 as will be described in more detail hereinafter. The actuating rod 48 and the twisting-preventive guide cylinder 35 are adapted to rotate about a conical gripper 49 and its pivot shafts 49*b*.

A pneumatic cylinder 51 is supported by a bracket 50 which is fixed to the machine frame 1 on the opposite side of the stepper motor 38. A lift ring 52 is securely joined to the lower end of an output shaft 51*a* which is extended downwardly from the cylinder 51. The lower end of a guide rod 53 with a topmost stopper flange 53*a* is securely joined to the lift ring 52. The guide rod 53 extends in parallel with the output shaft 51*a*. Engaging projections 52*a* project radially inwardly from the inner annular peripheral surface of the lift ring 52. A circular holding member 54 for holding the knitted fabric thereon is rotatably carried on the engaging projections 52*a* in such a manner that the holding member 54 will not drop. The guide rods 47 and the actuating rod 48 are loosely fitted vertically through the holding ring 54 in such a way that they are movable vertically. Furthermore, the holding ring 54 can rotate through the guide rods 47 and the actuating rod 48 in unison with the twisting-preventive guide cylinder 35 and the short hollow shaft 36. The conical gripper 49 is adapted to engage through the knitted fabric W an opening 54*a* of the holding ring 54, thereby gripping or clamping the knitted fabric.

A pair of first and second sensors S1 and S2 such as proximity switches are disposed in the vertical passage of the lift ring 52 and are spaced apart from each other by a suitable distance, thereby limiting the vertical stroke of the lift ring 52. Furthermore, a third sensor S3 such as a proximity switch is disposed to detect the lower portion Wa of the knitted fabric W. In response to an output signal from the third sensor S3, the pneumatic cylinder 51 is actuated to move the lift ring 52 and the holding ring 54 downwardly so that the opening 54*a* of the holding ring 54 will engage the conical gripper 49 through the knitted fabric W, thereby gripping or clamping the knitted fabric W.

Next the mode of operation of the first embodiment with the above-described construction will be described.

It is now assumed that stockings, panty hose or tights are to be knitted. The driving force generated by a driving power source drives the driving gear 4 mounted on the drive shaft 4*a* whereby the bevel gear 3 in mesh with the driving gear 4 is rotated, and consequently the needle cylinder 5 coupled to the bevel gear 3 with the sliding key is rotated. The needle cylinder 5 causes the knitting needles 8 to vertically reciprocate and by the cooperation with the sinkers 11 and the dial mechanism 15, yarns supplied from cones are knitted into stockings, panty hose or tights by the conventional knitting method. The knitted fabric W is guided downward into the twisting-preventive guide cylinder 35.

Meanwhile, compressed air supplied through the supply conduit 30 is supplied through the air passage 29 and blown through the opening 32 downward. On the other hand, the stepper motor 38 is also energized so that the output shaft 38*a* of the stepper motor 38 drives through the timing belt 39 the pulley 36*a* which in turn drives the twisting-preventive guide cylinder 35 in synchronism with the needle cylinder 5, whereby the knitted fabric W is prevented from being twisted.

Simultaneously with the transfer of the cylindrically knitted fabric W into the twisting-preventive guide cylinder 35, the compressed air supplied from the air supply conduit 30 is sent upwardly through the passage 29 and blown through the openings 32 downward so that the fabric W is moved downward. When the solenoid operated valve 25 is opened, the compressed air from the compressed air source 26 is supplied to the air supply passage 18 in the dial cap 16 of the dial mechanism 15 and is caused to blow downwardly through the downwardly-directed nozzle opening 45 of the conical nozzle 40, thereby forcing the knitted fabric W against the inner surface of the twisting-preventive guide cylinder 35 which is rotating in synchronism with the needle cylinder 5.

When the lower portion (the portion first knitted) Wa of the knitted fabric W drops down to a position in the vicinity of the L-shaped rod 49*a* of the conical gripper 49 which is vertically movable, the third sensor S3 detects the lower portion Wa and in response to the detection signal from the sensor S3, the pneumatic cylinder 51 is actuated so that its output shaft 51*a* is moved downward while being guided by the guide rod 53. Therefore, the opening 54*a* of the holding ring 54 engages the conical gripper 49 through the knitted fabric W, whereby the fabric W is gripped or clamped. The holding ring 54 and the conical gripper 49 are rotated in synchronism with the rotation of the twisting-preventive guide cylinder 35 through the actuating rod 48.

In the above-described manner, the knitted fabric W is deposited below the twisting-preventive guide cylinder 35, and a knitting cycle is finished. Then the pneumatic cylinder 51 is actuated in such a way that its output shaft 51*a* is moved upward while being guided by the guide rod 53. Thereupon, the upper limit of the vertical stroke of the lift ring 52 is detected by the second sensor S2, and, in response to the detection signal from the sensor S2, the operation of the cylinder 51 for retracting its output shaft 51*a* is stopped whereby the lift ring 52 is stopped at the upper limit of its stroke. Then the knitted fabric W is pulled downward through the opening 54*a* of the holding ring 54 along the outer surface of the conical gripper 49. Therefore, the knitted fabric W is prevented from being contaminated, damaged and further twisted so that the quality of the knitted fabric is improved.

Thereafter, the knitted fabric deposited below the twisting-preventive guide cylinder 35 is taken up by a knitted fabric pickup device to be described hereinafter, to be transferred to the following processing step where, for instance, the crotch portion of panty hose is stitched to the cylindrical knitted fabric.

As shown in FIGS. 1, 5, 6 and 7, a holding frame 55, L-shaped in horizontal section, extends horizontally from, and fixed to the machine frame 1 at a position below the holding ring 54, and a square through hole 55*b* is formed through a bent portion 55*a* of the holding frame 55. Two guide roller pairs 56 are provided, each pair consisting of an upper guide roller 56*a* and a lower guide roller 56*b* spaced apart from each other in the vertical direction by a suitable distance. The roller pairs 56 are spaced apart in the horizontal direction from each other by a suitable distance and are rotatably supported by guide roller shafts extended from one side surface of the holding frame 55. Those guide roller pairs 56 serve to guide reciprocal horizontal motion of a slider 57 with a stopper 57*a* at its one end. An inverted-U-shaped block 58 is securely joined to the other end of the slider 57 opposite to the stopper 57*a*. A horizontal pneumatic cylinder 59 is securely attached at one end thereof to the bent portion 55*a* of the holding frame 55 through a mounting member 60, and the output shaft 59*a* of the pneumatic cylinder 59 is connected to the block 58 by means of a connecting pin 61.

Therefore, when the pneumatic cylinder 59 is actuated, the slider 57 connected to the output shaft 59*a* of the cylinder 59 is caused to reciprocally slide in the horizontal direction.

Figure 5:
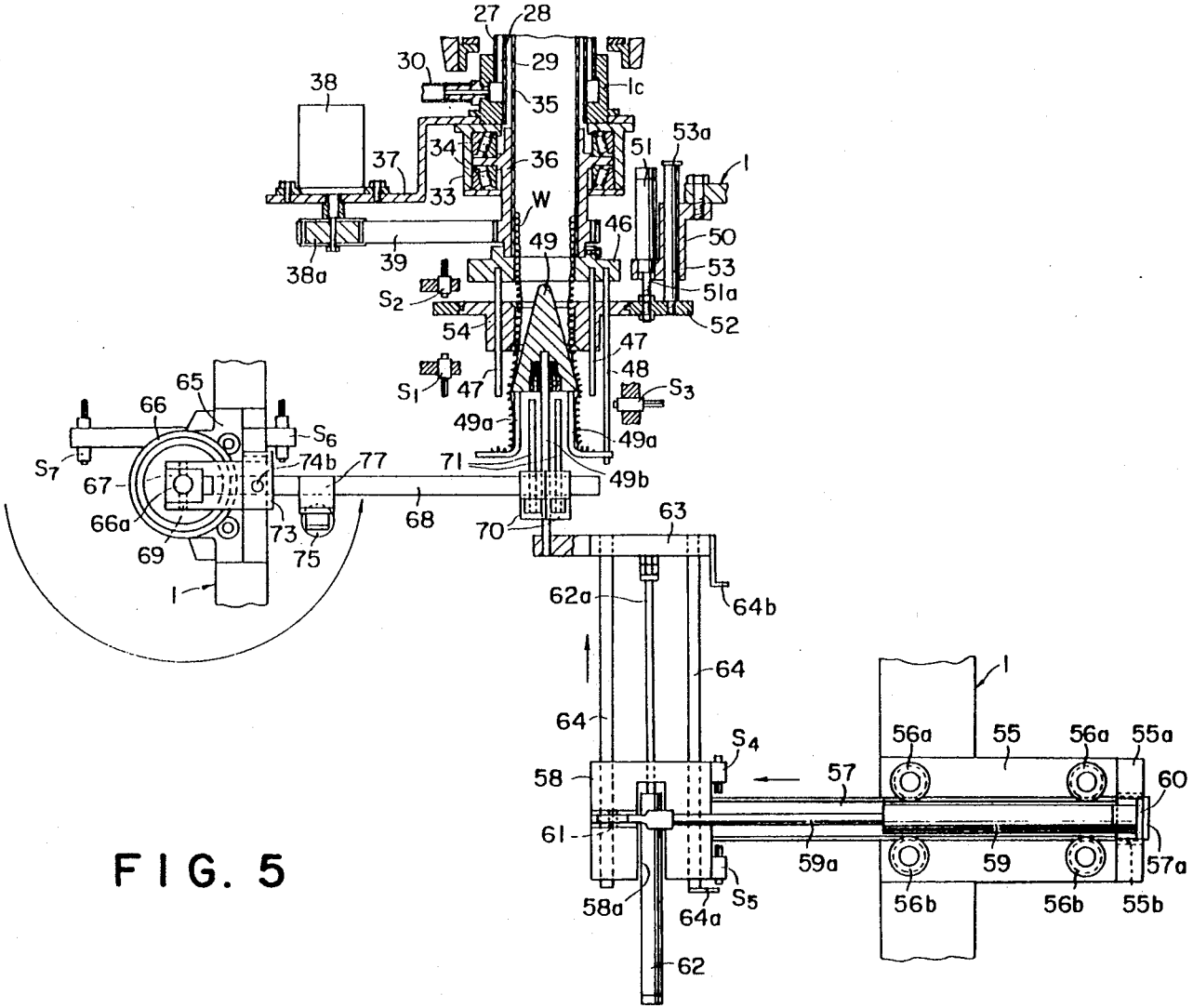
FIG. 5 is an elevation, with some portions in vertical section, showing a knitting fabric pickup device for transferring the fabric to a succeeding processing step.
Figure 6:
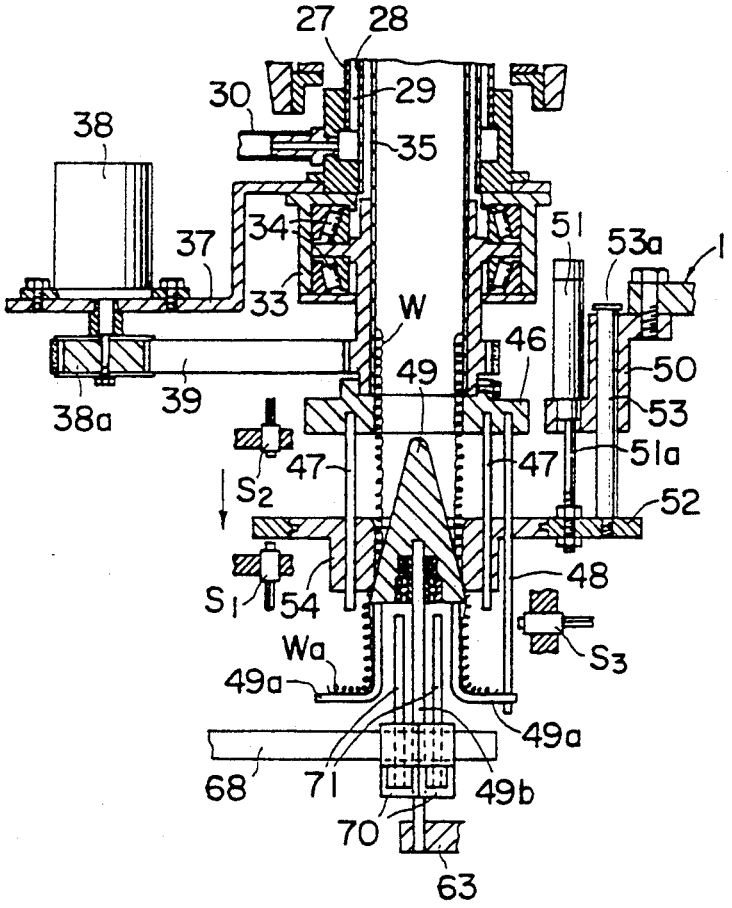
FIG. 6 is a vertical section of a part of the apparatus shown in FIG. 5, taking a different state.
Figure 7:
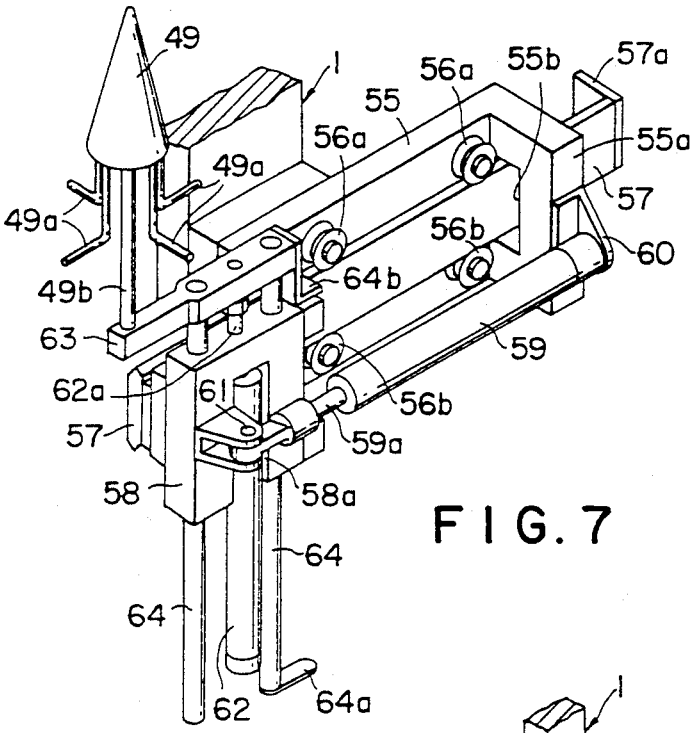
FIG. 7 is a perspective view of an assembly including a conical gripper and a mechanism for moving the conical gripper toward and away from a bottom part of a guide cylinder.

A vertical pneumatic cylinder 62 is securely joined to the bottom portion of the bifurcated portion 58*a* of the block 58, and an output shaft 62*a* of the vertical cylinder 62 is connected at an intermediate portion of a horizontal supporting rod 63 from which is extended upwardly a supporting shaft 49*b* of the conical gripper 49. The upper ends of a pair of guide rods 64 are securely joined to the horizontal supporting rod 63. The guide rods 64 extend through the block 58 in parallel with the vertical cylinder 62, to allow vertical sliding movement of the block 58 along the guide rods 64. An angularly bent lower stopper 64*a* is formed at the lower end of one of the guide rods 64. An upper stopper 64*b* is securely joined to one end of the horizontal supporting rod 63. As best shown in FIG. 5, a fourth sensor S4 and a fifth sensor S5 such as proximity switches are mounted on the block 58 along a path of vertical movement of the lower and upper stoppers 64*a* and 64*b*. The fourth and fifth sensors S4 and S5 limit the extent of vertical stroke of the conical gripper 49 supported by the horizontal supporting rod 63.

When the vertical pneumatic cylinder 62 is actuated, its output shaft 62*a* is shifted vertically under guidance by the guide rods 64 to vertically shift the conical gripper 49, while the fourth and fifth sensors S4 and S5 limit the extent of the vertical stroke of the conical gripper 49.

Figure 8:
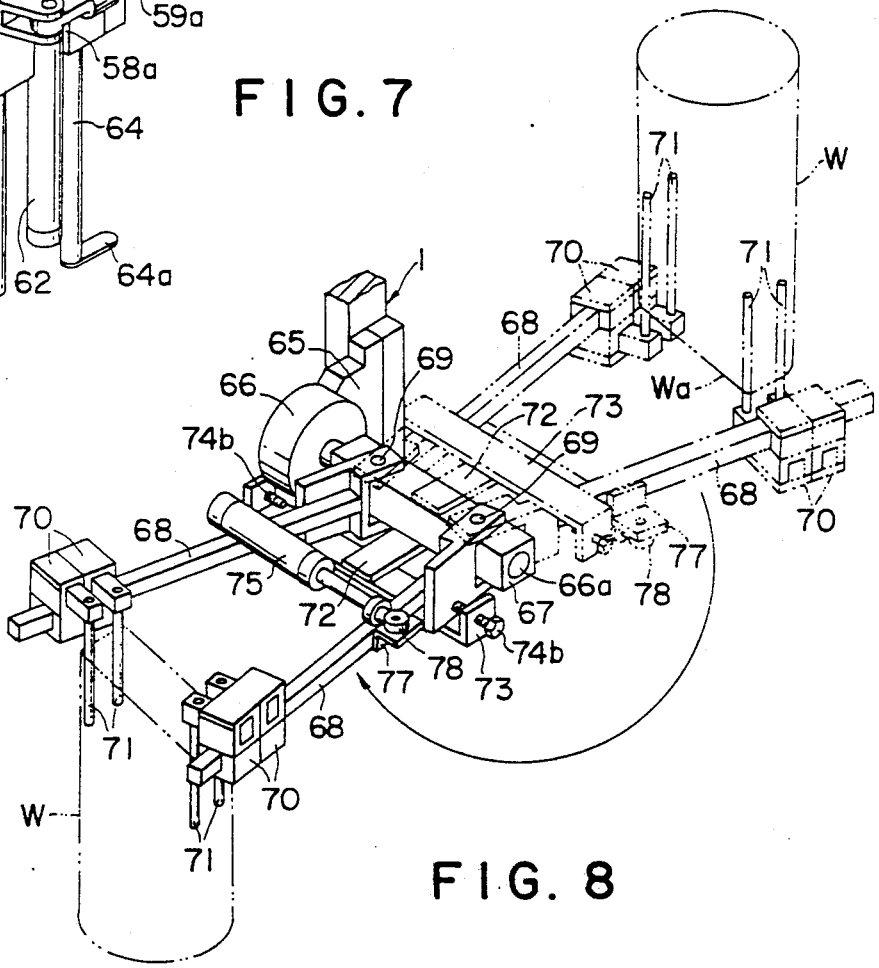
FIG. 8 is a perspective view of a mechanism for picking up a cylindrically knitted fabric from the bottom part of the guide cylinder.

As best shown in FIGS. 1 and 5, a mount 65 is adjustably secured to the machine frame 1 below the knitted-fabric holding ring 54, and an actuator 66 such as a rotary actuator is horizontally mounted on one side of the mount 65. As best shown in FIG. 8, a horizontal shaft 67 in the form of a rod square in cross section is securely fitted over an output shaft 66*a* of the actuator 66. The base end of each of a pair of divergently arranged legs 68 is pivoted to the horizontal supporting shaft 67 by a pivot pin 69 in such a way that each leg 68 can pivot in a horizontal plane. One pair of sliders 70 is fitted over the free end portion of each leg 68 in such a way that the slider pair 70 is movable in the lengthwise direction of each leg 68. A pair of pickup rods 71 extend downwardly in such a way that they can enter the region surrounded by the L-shaped rods 49*a*.

Figure 9:
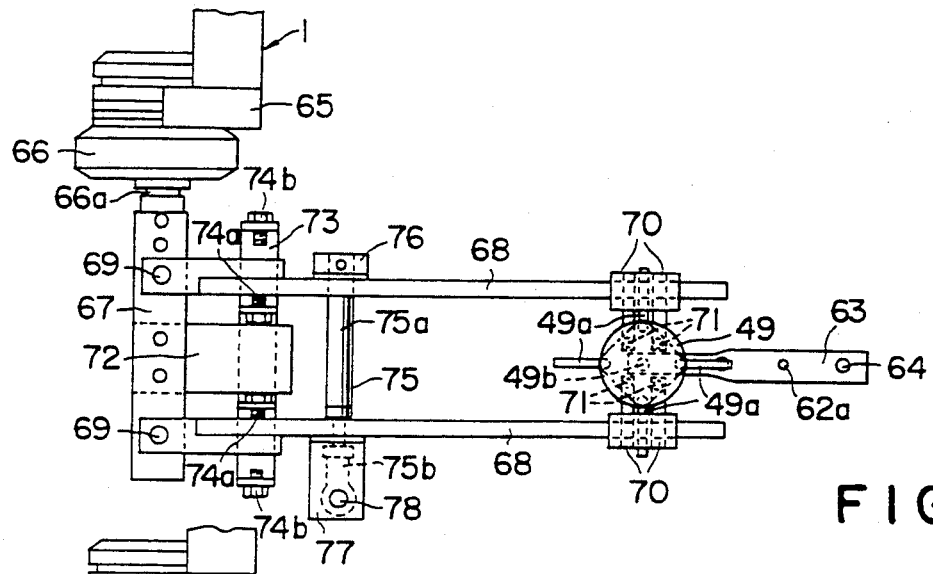
FIG. 9 is a plan view of the mechanism shown in FIG. 8, the mechanism being shown in a position swung below the bottom part of the guide cylinder.

Furthermore, as shown in FIG. 9, a mounting plate 72 is extended from the lower side of the horizontal supporting shaft 67 between the pivot pins 69. A stopper mounting member 73 is horizontally attached to the free end of the mounting plate 72 perpendicular to the legs 68. A pair of stoppers 74*a* and 74*b* are attached to each end of the stopper mounting member 73 in such a way that they can adjust the angle of pivotal motion of each legs 68. A leg opening cylinder 75 is interconnected between the legs 68 in the vicinity of the stoppers 74*a* and 74*b*.

More specifically, the main body 75*a* of the cylinder 75 is joined to one of the legs 68 by means of a bracket 76 and an output shaft 75*b* of the cylinder 75 is connected to the other leg 68 through a bracket 77 and a pin 78.

As shown in FIG. 5, a pair of sixth and seventh sensors S6 and S7 such as proximity switches are mounted on the mount 65 in order to detect the terminal positions of pivotal motion (180°) of each leg 68, thereby limit the stroke of the output shaft 75*b* of the cylinder 75.

Figure 10:
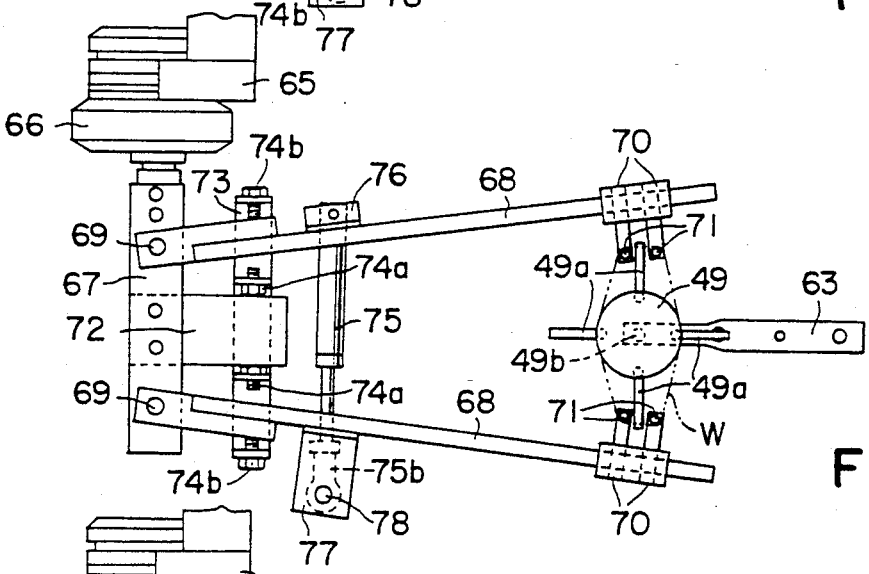
FIG. 10 is a plan view of the mechanism of FIG. 8, in a different state during picking up of a knitted fabric.
Figure 11:
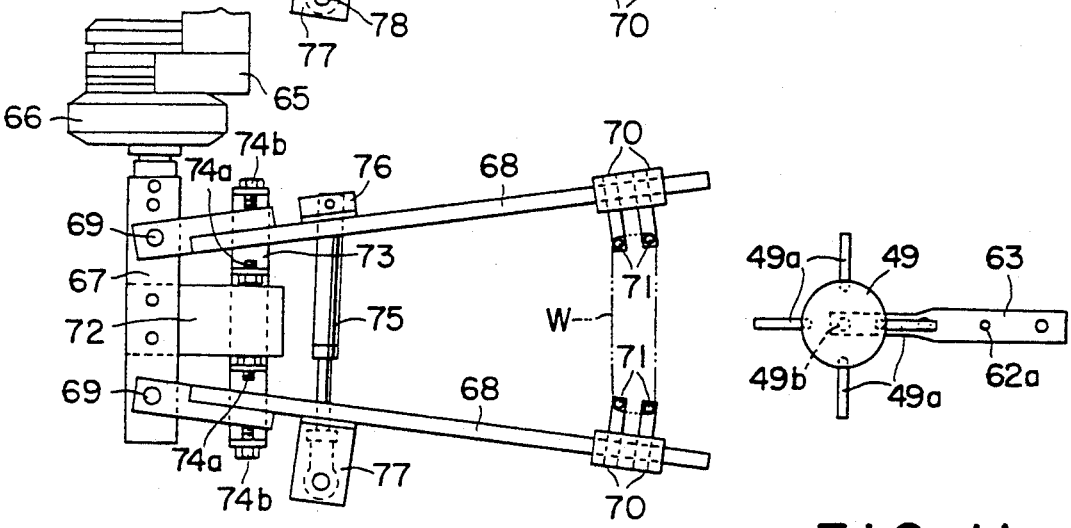
FIG. 11 is a view similar to FIG. 10 but showing a different state in which the knitted fabric has been completely picked up.

It follows therefore that when the actuator 66 is actuated to cause the pickup rod pairs 71 to enter the region surrounded by the L-shaped rods 49*a* to receive the knitted fabric W, the horizontal supporting shaft 67 integral with the output shaft 66*a* of the actuator 66 is rotated through 180°, to rotate the legs 68 from the position indicated by the solid lines in FIG. 8 to the position indicated by the two-dot chain lines in FIG. 8, whereby the pickup rod pairs 71 enter the inside region of the L-shaped rods 49 as shown in FIG. 5. Thereafter, as shown in FIG. 10, the cylinder 75 is actuated such that its output shaft 75*b* is extended from the cylinder main body 75*a* until the legs 68 engage their corresponding stoppers 74*b* and are then stopped. As a result, the pickup rod pairs 71 move out of the region of the L-shaped rods 49*a*, whereby the knitted fabric W is transferred from the L-shaped rod 49*a* onto the pickup rod pairs 71. Next the vertical cylinder 62 is actuated to move the L-shaped rods 49*a* downwardly as shown in FIG. 11, and the knitted fabric W is completely received by the pickup rod pairs 71. Thereafter, the rotary actuator 66 is actuated in reverse rotation so that the horizontal supporting shaft 67 integral with the output shaft 66*a* of the actuator 66 is rotated together with the legs 68 in the clockwise direction through 180° to the initial or home position indicated by the solid lines in FIG. 8 and the knitted fabric thus picked up is transferred to the next processing step.

The mode of operation of the knitted-fabric pickup device will be described below.

When the knitted fabric W is received below the twisting-preventive cylinder 35 as shown in FIG. 5 and one knitting step has been completed, the output shaft 51*a* of the pneumatic cylinder 51 is retracted upward under the guidance by the guide rod 53, whereby the holding ring 54 is moved upward. The holding ring 54 is stopped at the upper end of its vertical stroke in response to the detection signal from the second sensor S2. Then the knitted fabric W deposited below the twisting-preventive guide cylinder 35 is picked up by the knitted fabric pickup device to be transferred to the next processing step where, for instance, the crotch portion of the panty hose is stitched.

More specifically, as best shown in FIG. 5, the pickup rod pairs 71 enter the inside region surrounded by the L-shaped rods 49*a* holding the knitted fabric W to pick up the same. That is, the rotary actuator 66 is energized, and the horizontal supporting shaft 67 on the output shaft 66*a* of the actuator 66 is rotated together with the legs 68 through 180°, to cause the pickup rod pairs 71 to enter the inside region of the L-shaped rods 49*a*. Thereafter, as best shown in FIG. 10, the output shaft 75*b* of the cylinder 75 is extended to open the legs 68 and stopped when the legs 68 engage their corresponding stoppers 74*b*, respectively, whereby the knitted fabric W is transferred from the L-shaped rods 49*a* to the pickup rod pairs 71. Thereafter the output shaft 62*a* of the cylinder 62 is retracted so that the L-shaped rods 49*a* are moved downward. Then the output shaft 59*a* of the horizontal cylinder 59 is retracted and the rods 49*a* are returned to their initial position, whereby the knitted fabric W is completely transferred onto the pickup rod pairs 71.

Thereafter, the rotary actuator 66 is reversed in rotation so that the square rod 67 on the output shaft 66*a* of the actuator 66 is rotated together with the legs 67 through 180° in the clockwise direction to return to its initial position indicated by the solid lines in FIG. 8. Then the knitted fabric W is transferred to the next processing station.

As described above, after the pickup rod pairs 71 have received the knitted fabric W from the L-shaped rods 49*a*, the rod pairs 71 are rotated through 180° in the opposite direction to automatically transfer the knitted fabric W to the next processing step so that the manual operation is eliminated and labor-saving is attained.

Figure 12:
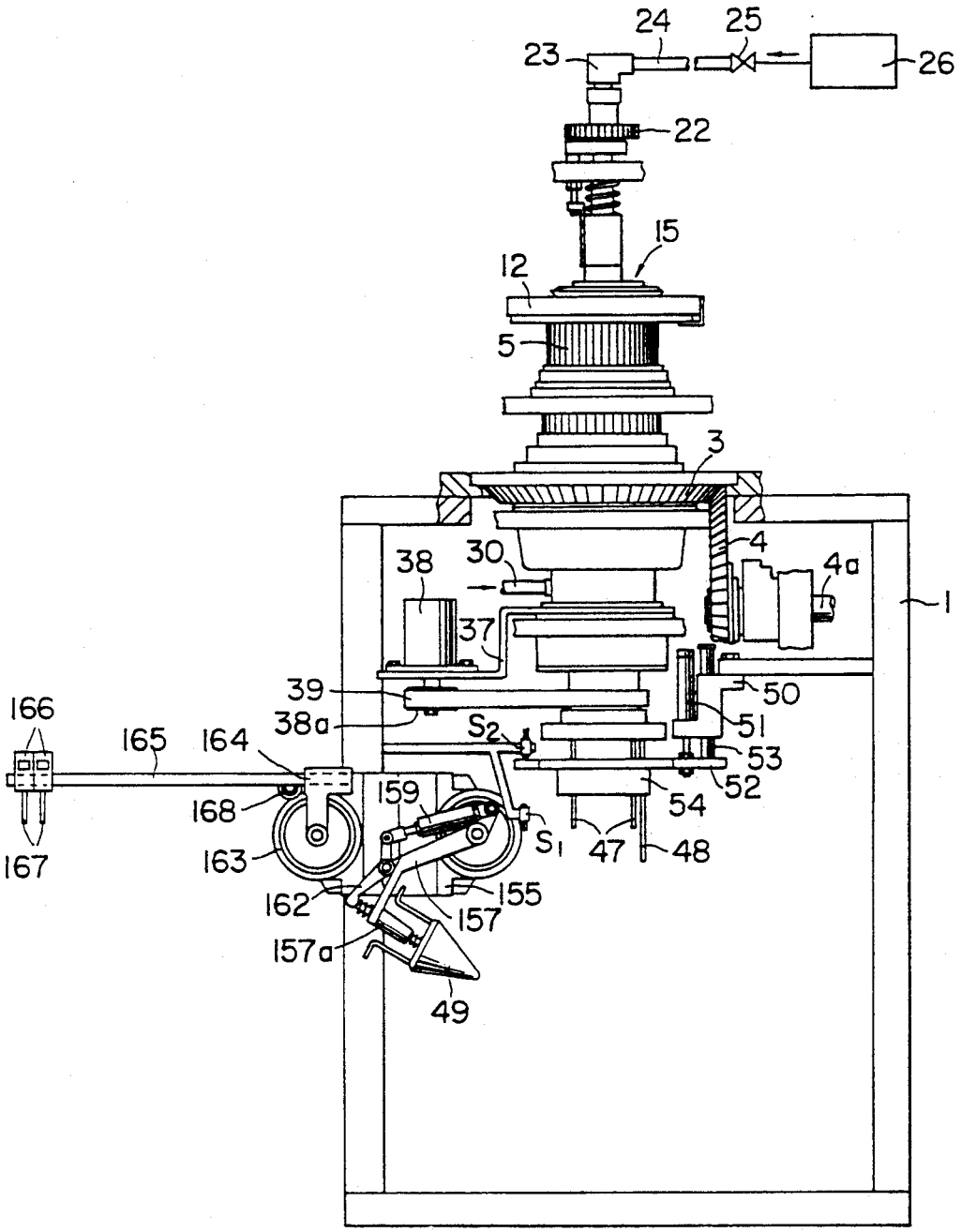
FIG. 12 is a front elevation similar to FIG. 1 but showing a modified form.
Figure 13:
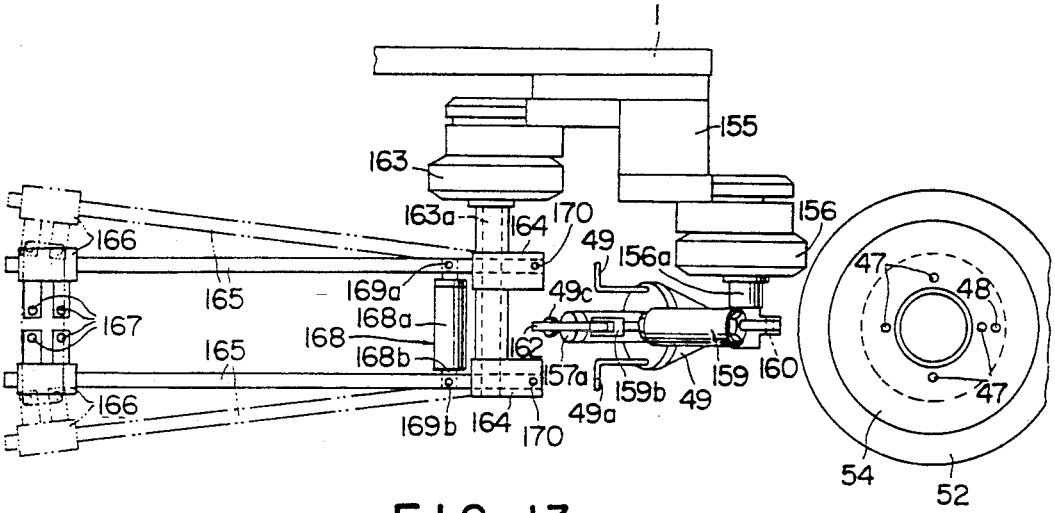
FIG. 13 is a plan view, on an enlarged scale, of a mechanism for picking up a knitted fabric, used in the apparatus of FIG. 12.
Figure 14:
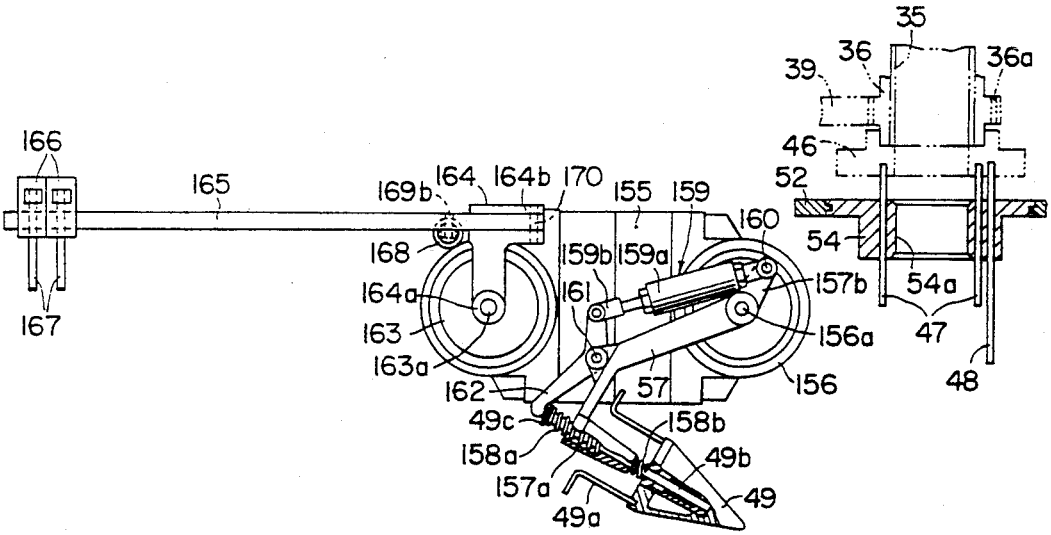
FIG. 14 is a front view of the mechanism of FIG. 13.

Referring next to FIGS. 12 through 17, a further embodiment of the present invention will be described. As shown in FIG. 12, a mount 155 is joined to one side of the machine frame 1, and a rotary actuator 156 is horizontally mounted on one side of the mount 155. As shown in FIG. 14, the base of a swing lever 157 is securely connected to a horizontally extending output shaft 156*a* of the actuator 156 in such a way that when the actuator 156 is actuated, the lever 157 is caused to swing through about 120° about the axis of the output shaft 156*a*. A supporting shaft 49*b* of a conical gripper 49 is slidably supported by a frustoconical bearing 157*a* securely attached to the free end of the swing lever 157. Strong and weak coil springs 158*a* and 158*b* are fitted over the supporting shaft 49*b* in such a way that these springs 158*a* and 158*b* are prevented from falling off from the supporting shaft 49*b* and that the degree of freedom can be adjusted in the case of the engagement of the conical gripper 49 with the holding ring 54. The gripper 49 is normally biased rearward by the springs 158*a* and 158*b*.

A main body 159*a* of an assisting pneumatic cylinder 159 is pivoted at an end 157*b* of the swing lever 157 with a pivot pin 160, and an output shaft 159*b* of the assisting cylinder 159 is pivoted at one end of an assisting lever 162 which in turn is pivoted to the midpoint between the ends of the swing lever 157 with a pivot pin 161. The other end of the assisting lever 162 is extended to push forwardly the tail end 49*c* of the supporting shaft 49*b* against the coil springs 158*a* and 158*b*.

Figure 15:
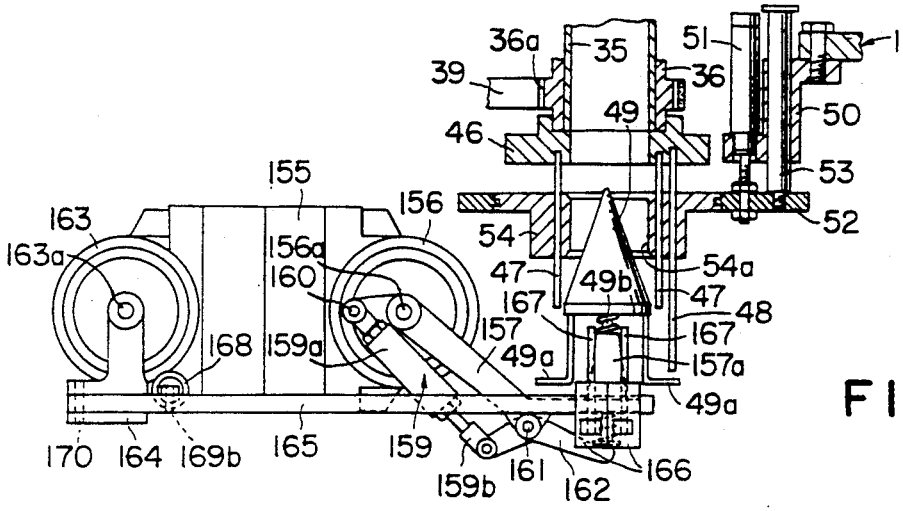
FIGS. 15, 16 and 17 are front views of the mechanism of FIG. 14, showing different operational states.
Figure 16:
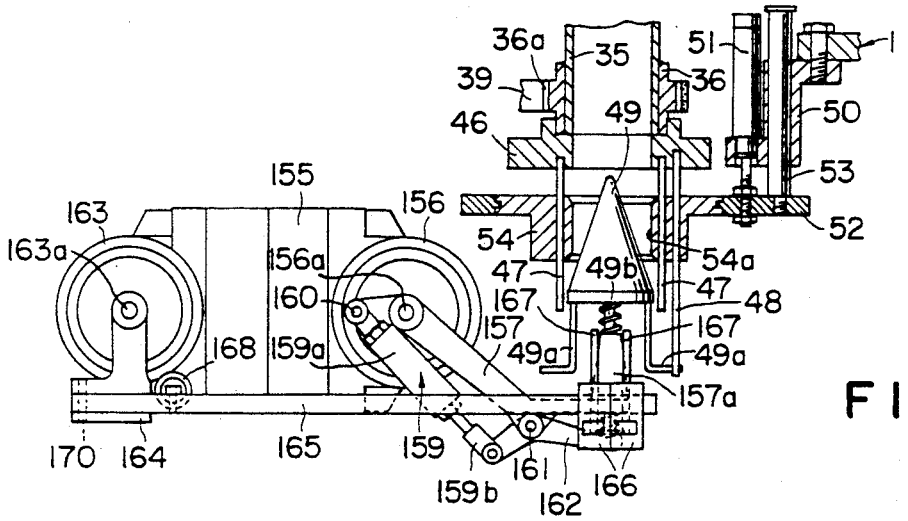
Figure 17:
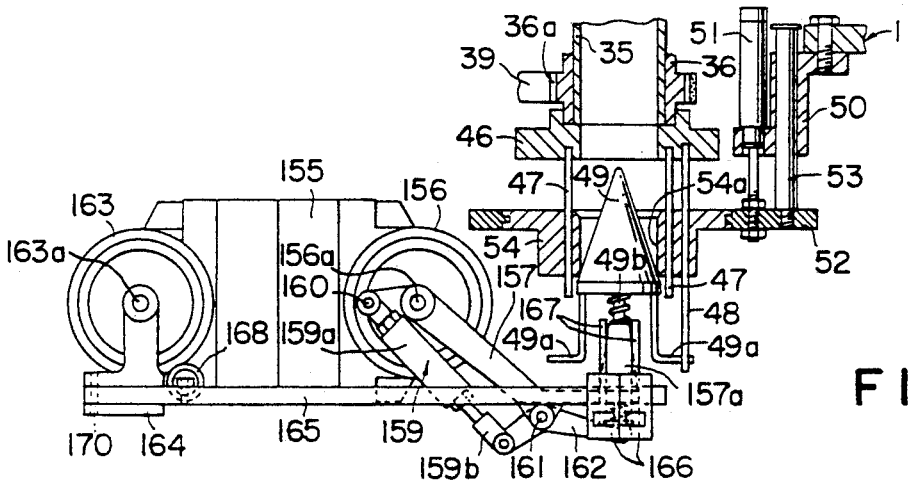

When the actuator 156 is energized, its output shaft 156*a* is rotated through about 120° in the counterclockwise direction in FIG. 14 so that the swing lever 157 which is pivoted to the output shaft 156*a* is rotated about the output shaft 156*a* in the counterclockwise direction as shown in FIG. 15. As a result, the conical gripper 49 integral with the supporting shaft 49*b* supported by the bearing 157*a* of the swing lever 157 is inserted into the opening 54*a* of the knitted-fabric holding ring 54. Therefore, as indicated in FIG. 16, the L-shaped rods 49*a* of the conical gripper 49 are brought into engagement with the actuating rod 48 so that the conical gripper 49 is rotated in synchronism with the twisting-preventive guide cylinder 35 through the actuating rod 48. When the assisting cylinder 159 is energized, the assisting lever 162 pushes the tail end 49*c* of the supporting shaft 49*b* against the coil springs 158*a* and 158*b*. As a result, the engagement of the conical gripper 49 with the opening 54*a* of the holding ring 54 through the knitted fabric W can be elastically assisted so that the knitted fabric W can be elastically supported while the holding ring 54 and the conical gripper 49 are rotated in synchronism with the twisting-preventive cylinder 35 through the actuating rod 48.

Meanwhile, as shown in FIGS. 12, 13 and 14, a rotary actuator 163 is horizontally mounted on the other side of the mount 155 fixed to the machine frame 1. The bases 164*a* of a pair of horizontal supporting members 164 are securely joined to the output shaft 163*a* of the actuator 163 and are spaced apart from each other by a predetermined distance. The bases of a pair of legs 165 are pivoted with pivot pins 170, respectively, on the upper portions 164*b*, respectively, of the horizontal supporting members 164 in such a way that legs 165 can pivot in the horizontal direction. A pair of sliders 166 are slidably fitted over the free end portion of each leg 165 in such a way that the lengthwise adjustment can be made. A pair of pickup rods 167 depend from the slider pair 166 in such a way that they can be inserted into region of the L-shaped rods 49*a*. The pair of the leg 165 are interconnected by a horizontal pneumatic cylinder 168 for opening or closing them, adjacent to the supporting members 164.

More specifically, the main body 168*a* of the pneumatic cylinder 168 is pivoted with a pivot pin 169*a* to one of the legs 165 while the output shaft 168*b* of the cylinder 168 is pivoted with a pivot pin 169*b* to the other leg 165.

When the actuator 163 is energized, the supporting members 164 fixed to the output shaft 163*a* of the actuator 163 are rotated together with the legs 165 through about 180° in the counterclockwise direction from the state indicated in FIG. 14 to the state shown in FIG. 15 so that the pickup rods 167 are advanced into the region of the L-shaped rods 49*a*. Thereafter, the cylinder 168 is energized so that its output shaft 168*b* is extended and then stopped when the legs 165 are angularly spaced apart from each other by a predetermined angle. As a result, the knitted fabric W is transferred from the L-shaped rods 49 to the pickup rods 167. Then the actuator 156 is reversed in rotation and the output shaft 159*b* of the assisting cylinder 159 is retracted so that the knitted fabric W is completely transferred to the pickup rods 167. When the actuator 163 is reversed in rotation, the supporting members 164 mounted on the output shaft 163*a* of the actuator 163 are rotated reversely together with the legs 165 through about 180° so that the pair of legs 165 are returned to their initial position and the knitted fabric W is transferred to the next processing step.

The mode of operation of this embodiment is as follows.

It is assumed that the knitted fabric W is deposited below the twisting-preventive guide cylinder 35 after one knitting cycle and the needle cylinder 5 is stopped. Then, the pneumatic cylinder 51 is energized so that its output shaft 51*a* is moved upward under the guidance by the guide rod 53. When it is moved upward to the top end of its vertical stroke, this is detected by the second sensor S2 and in response to the detection signal therefrom, the upward movement of the output shaft 51*a* and the holding ring 54 is stopped. The knitted fabric W below the twisting-preventive guide cylinder 35 is then transferred to the knitted-fabric pickup device which in turn transfers it to the next processing step.

In order to transfer the knitted-fabric W, the actuator 163 is energized so that the pair of the legs 165 are rotated in the counterclockwise direction through about 180° as shown in FIGS. 15 and 16. Therefore, the pickup rod pairs 167 are inserted into the region of the L-shaped rods 49*a*. Then, the cylinder 168 is energized so that its output shaft 168*b* is extended and stopped when the legs 165 and the pickup rods 167 are angularly spaced apart from each other by a predetermined angle. As a result, the knitted fabric W is transferred from the L-shaped rods 49*a* to the pickup rod pairs 167. Thereafter, when the actuator 156 is reversed in rotation to move the conical gripper 49 away and the output shaft 159*a* of the assisting cylinder 159 is retracted, the knitted fabric W is completely transferred to the pickup rod pairs 167. Then, when the actuator 163 is reversed in rotation, the pair of legs 165 are swung in the clockwise direction through about 180° to their initial position indicated in FIG. 14, and the knitted fabric W is transferred to the next processing step.

As described above, after the pickup rod pairs 167 have received the knitted fabric W from the L-shaped rods 149*a*, they are swung together with the legs 165 through about 180° in the clockwise direction to their initial positions, respectively and the knitted fabric is automatically transferred to the next processing step. As a result, manual operation can be eliminated and the labor saving can be attained.

What is claimed is:

1. Apparatus for transferring a knitted fabric from a circular knitting machine having a rotating upright needle cylinder carrying knitting needles, and a dial mechanism provided above the top of the needle cylinder, said needle cylinder having therein an upright hollow guide cylinder which rotates in synchronism with the needle cylinder and through which a cylindrical fabric knitted in a knitting region adjacent to the top of the needle cylinder is fed downward, and means for pneumatically drawing the knitted fabric against the inner surface of the cylindrical guide, said apparatus comprising:

a conical air nozzle provided in the top of the needle cylinder concentrically therewith and having a downwardly converging frustoconical outer surface, said nozzle being so disposed directly below said knitting region as to guide the cylindrically knitted fabric downward along and around said frustoconical outer surface and as to eject air downward into the cylindrically knitted fabric to pneumatically urge the fabric against the inner surface of the guide cylinder;

opening means provided around said air nozzle for blowing air downwardly to cause the cylindrically knitted fabric around the air nozzle to be pneumatically moved downward; and knitted fabric pickup means provided below the needle cylinder for picking up the knitted fabric deposited below said guide cylinder and for transferring the fabric away from the knitting machine.

2. The apparatus according to claim 1, wherein said conical air nozzle has a plurality of air ejection passages arranged in an annular row, and air injection openings disposed in an annular row and communicating with said ejection passages.

3. The apparatus according to claim 1, further comprising air supply passage means for supplying compressed air into the air nozzle downwardly through said dial mechanism.

4. The apparatus according to claim 1, further comprising:

concentric outer and inner cylinders disposed around said guide cylinder, said outer and inner cylinders defining an annular air passage therebetween;

compressed air supply conduit means communicating with a lower portion of said air supply passage; and said opening means being in communication with an upper portion of said air supply passage.

5. The apparatus according to claim 1, further comprising:

a holding ring provided below the guide cylinder coaxially therewith so as to be movable vertically toward and away from the guide cylinder and so as to be rotatable with said guide cylinder;

a conical gripper provided to be movable from below into said holding ring so as to receive the knitted fabric thereon and to cooperate with the holding ring for gripping the knitted fabric therebetween and for releasing the fabric when the holding ring is moved upwardly relative to the conical gripper;

a mechanism carrying said conical gripper for moving the same away from the holding ring; and means for transmitting rotation of the guide cylinder to the conical gripper to rotate the latter in synchronism with the holding ring when the conical gripper has moved into the holding ring.

6. The apparatus according to claim 5, wherein said means for transmitting rotation comprises:

L-shaped rods fixedly depending from the conical gripper to form radially outwardly projecting engaging extensions; and an actuating rod being integral with the guide cylinder and extending downward so as to engage said extensions when the conical gripper has moved into the holding ring.

7. The apparatus according to claim 5, further comprising:

a lift ring carrying said holding ring rotatably therein; and motive power means for moving the lift ring vertically toward and away from the guide cylinder.

8. The apparatus according to claim 5, wherein said mechanism carrying said conical gripper comprises:

a supporting member rotatably supporting said conical gripper upright;

slide means for moving said supporting member vertically toward and away from the holding ring; and means carrying said slide means for moving the same horizontally toward and away from a position directly below said holding ring.

9. The apparatus according to claim 5, wherein said mechanism carrying said conical gripper comprises:

a swing lever pivotable about a horizontal axis and rotatably carrying said conical gripper on a free end thereof, said swing lever being capable of selectively taking an advanced position in which the conical gripper is moved into the holding ring and a retracted position in which the conical gripper is swung downwardly away from the holding ring; and an actuator for pivoting the swing lever between said advanced and retracted positions.

10. The apparatus according to claim 9, further comprising:

spring means for normally retracting the conical gripper on said free end of the swing lever; and assisting means for advancing the conical gripper against the force of the spring means when the assisting means is actuated.

11. The apparatus according to claim 5, wherein said knitted fabric pickup means comprises:

a pair of legs pivoted at proximal ends thereof so as to extend normally in parallel relation;

means for pivotally moving the legs away from each other so that the legs will assume a diverging state;

pickup rods fixedly mounted upright on distal ends of the legs, respectively, such that the pickup rods will be more spaced apart in the diverging state of the legs than in the normal parallel state of the legs; and power means coupled to said legs for moving the legs between an advanced position in which said pickup rods are below the conical gripper which has moved into the holding ring and a retracted position in which said pickup rods are away from the holding ring, whereby the knitted fabric held on the conical gripper is picked up by the pickup rods by causing the legs to take the diverging state so as to move apart the pickup rods, and the knitted fabric is transferred away from the holding ring by moving the legs to said retracted position.

12. The apparatus according to claim 11, wherein said power means is a rotary actuator coupled to the legs for causing the legs to swing between said advanced position and the retracted position.

13. The apparatus according to claim 11, wherein the L-shaped rods fixedly depend from the conical gripper to form radially outwardly projecting engaging extensions, and said pickup rods are disposed in a region inside the L-shaped rods when the legs assume the normal parallel state, said pickup rods being outside said region when the legs assume the diverging state.

* * * * *